US005302088A

United States Patent [19]

Gronski et al.

[11] Patent Number: 5,302,088

[45] Date of Patent: Apr. 12, 1994

[54] WATER POWERED SUMP PUMP

[76] Inventors: Michael L. Gronski, 4260 N. Steele Rd., Hemlock, Mich. 48626; Leslie M. Tyner, 14 E. Hannum Blvd., Saginaw, Mich. 48602

[21] Appl. No.: 998,797

[22] Filed: Dec. 30, 1992

[51] Int. Cl.[5] ..... F04F 5/48

[52] U.S. Cl. ..... 417/182.5; 417/188; 251/45

[58] Field of Search ..... 417/181, 182.5, 188; 251/45

[56] References Cited

U.S. PATENT DOCUMENTS

| | | | |
|---|---|---|---|
| D. 283,225 | 4/1986 | Canvasser . | |
| 318,185 | 5/1885 | Haydn | 417/182.5 |
| 1,810,473 | 6/1931 | Gaines | 417/182.5 |
| 2,578,143 | 12/1951 | McGarry | 417/188 |
| 2,855,861 | 10/1958 | Miles et al. | 417/182.5 |
| 3,379,406 | 4/1968 | Greer | 251/45 |
| 3,963,376 | 6/1976 | Miskin | 417/182.5 |
| 4,060,341 | 11/1977 | Tremain et al. | 417/182.5 |
| 4,099,701 | 7/1978 | Berger | 251/45 |
| 4,963,073 | 10/1990 | Tash et al. | 417/181 |
| 4,967,996 | 11/1990 | Sonoda et al. | 251/45 |

*Primary Examiner*—Richard A. Bertsch
*Assistant Examiner*—Roland G. McAndrews, Jr.
*Attorney, Agent, or Firm*—Learman & McCulloch

[57] ABSTRACT

A water powered sump pump has a control housing connected to a source of water under pressure and to a drain pipe located in a sump. An outlet pipe leads from the control housing to a suction generating assembly in communication with the drain pipe for entraining water from the sump for discharge elsewhere. A diaphragm closure normally closes a water passage in the housing and divides the housing into two chambers. A passageway through the diaphragm enables the pressure of water in the two chambers to be equalized. A bleed line communicates between one of the chambers and the sump. A valve responsive to the rise of water in the sump initiates the flow of water through the bleed line, thereby enabling lowering of the pressure in the chamber with which the bleed line communicates and enabling the pressure of water in the other chamber to unseat the diaphragm and open the passage.

10 Claims, 2 Drawing Sheets

WATER POWERED SUMP PUMP

This invention relates to a pump that is particularly well adapted for use in maintaining water in a sump at a selected level, and more particularly to such a pump which is operable solely in response to the flow of water from a pressurized source, thereby avoiding reliance upon electrical or other external actuating means.

BACKGROUND OF THE INVENTION

The use of a sump pump in the basement of a residence or other building is conventional for the purpose of avoiding flooding of the basement. Most sump pumps rely upon normally inactive, electrically driven motors to operate the pump in response to a predetermined rise in the level of water in the sump. In many instances, however, a storm or other condition which causes a rise in the water level also causes electrical power failure, thereby rendering the sump pump useless at the very time that the need for it is greatest.

Other sump pumps rely upon float-actuated valves in conjunction with magnetic devices for controlling the operation of the sump pump. Such magnetic devices, however, loose their magnetism over a period of time, thereby rendering them ineffective to actuate the sump pump when needed.

A sump pump constructed in accordance with the invention relies solely upon the flow of pressurized water, such as potable water provided by a municipality, thereby eliminating the need for reliance upon an electrical or any other external power source.

SUMMARY OF THE INVENTION

A sump pump constructed in accordance with the preferred embodiment of the invention comprises a control housing having an inlet adapted for connection to a source of pressurized water, an outlet in communication with an outlet line, and a drain line located in a sump in which water may collect. The outlet line also is in communication with suction generating means that is operable in response to the flow of water from the control housing through the outlet line to entrain water from the sump for delivery to a sewer or other disposal area.

The control housing has an internal partition which separates the water inlet from the water outlet. The partition has a passage therein through which water may flow. The passage normally is maintained closed by a diaphragm closure through which a passageway extends. The diaphragm divides the control housing into two chambers one of which is of substantially uniform pressure and the other of which is of variable pressure. The passageway in the diaphragm enables restricted flow of water from one chamber to the other. The diaphragm is urged toward its passage-closing position by a spring.

In communication with the variable pressure chamber of the control housing is a bleed line which communicates with the sump drain line via a rotary valve. The valve is coupled to a float which is adapted to respond to the rise and fall of water in the sump to open and close the valve, thereby enabling and disabling the flow of water from the variable pressure chamber through the bleed line. Opening of the rotary valve in response to movement of the float enables water to flow from the variable pressure chamber, thereby reducing the pressure in such chamber. A reduction of pressure in such chamber enables the pressure of water in the substantially uniform pressure chamber to displace the diaphragm closure and open the passage between the inlet and outlet of the control housing, thereby enabling water to flow from the pressurized source through the control housing and through the water outlet line. Water flowing through the outlet line generates suction adjacent the sump drain line, thereby enabling water in the sump to be entrained and flow out of the sump for discharge elsewhere.

When the water level in the sump recedes, the float effects closure of the rotary valve thereby sealing the bleed line, whereupon pressure in each of the two chambers of the control housing equalizes enabling return of the diaphragm closure to its closed position and terminating the flow of water through the control housing.

THE DRAWINGS

A water powered sump pump constructed in accordance with the presently preferred embodiment of the invention is disclosed in the accompanying drawings, wherein:

FIG. 1 is an elevational view of the apparatus in the position it occupies when installed in a sump in condition for use;

FIG. 1*a* is a schematic diagram of a rotary valve;

THE DISCLOSED EMBODIMENT

Figures 1, 1A:
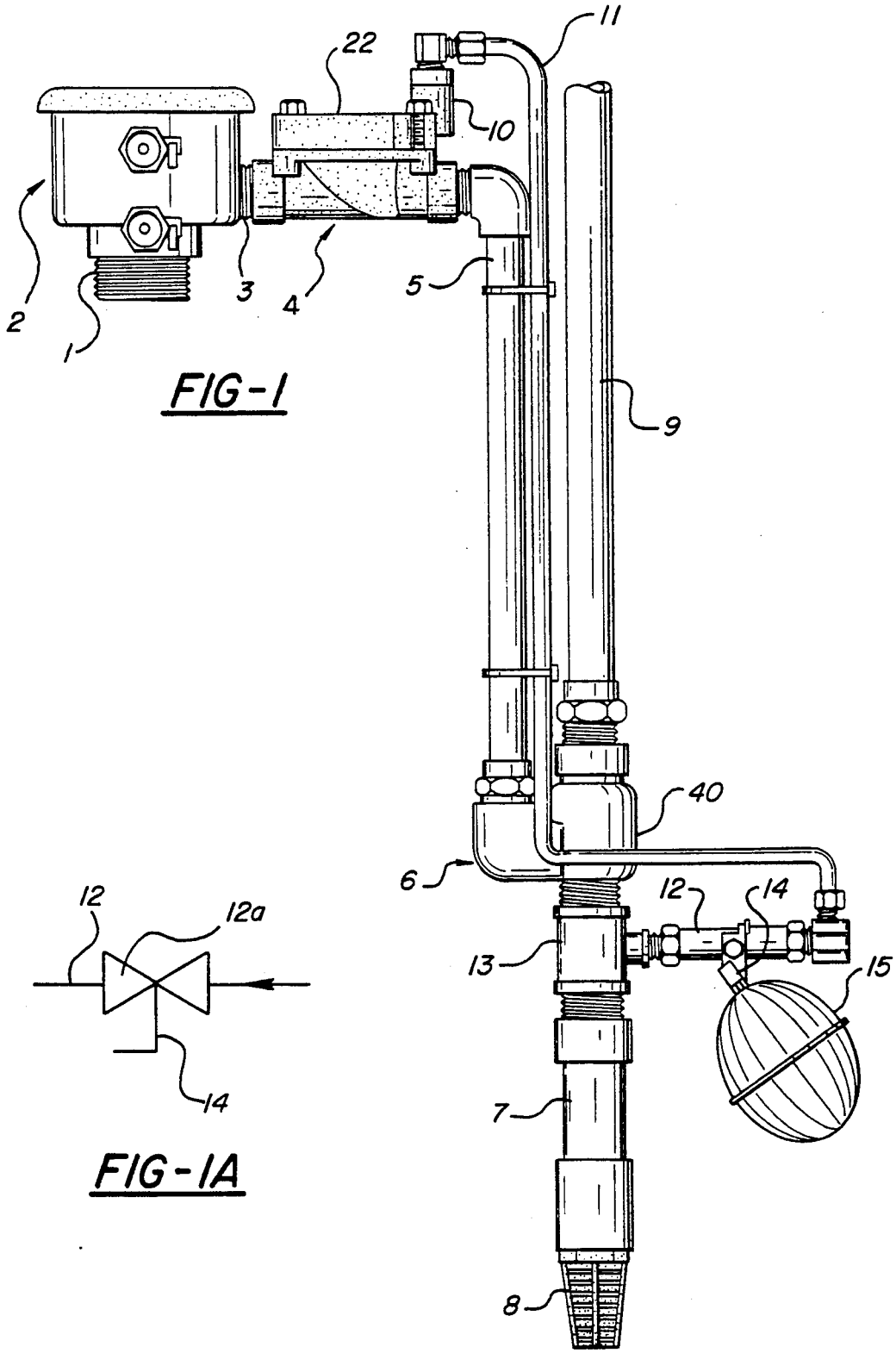

Apparatus constructed in accordance with the presently preferred embodiment of the invention comprises a liquid inlet line 1 connected to a source (not shown) of water under pressure, such as the potable water system of a municipality. Typically, the pressure of the potable water supply is between 25 and 80 psi. The inlet line 1 communicates with a conventional pressure vacuum breaker 2, such as the Wilkins Model 720AL vacuum breaker which permits water to flow in a direction from the source, but precludes return flow through the breaker in a direction toward the source.

Water from the breaker 2 passes through an inlet line 3 into a control apparatus housing indicated generally by the reference character 4 and which will be described in more detail hereinafter. Coupled to the housing 4 is one end of a water outlet line, the opposite end of which is coupled to a suction generating apparatus 6 of conventional construction. The apparatus 6 also is coupled to drain line 7 that is adapted to extend into a sump and has an open end provided with a strainer 8 through which water from the sump may pass into the drain line 7. The apparatus 6 also is connected to one end of a discharge line 9 which leads to a sewer or other area for disposal..

Connected to the control housing 4 is a tubular fitting 10 to which one end of a bleed line 11 is coupled. The opposite end of the bleed line is connected to one end of a valve housing 12, the opposite end of which is coupled to a tubular fitting 13 forming part of the drain line 7. Within the valve housing 12 is a rotary actuating valve 12*a* of conventional construction to which is connected an operating arm 14 that is fixed to a float 15. The float 15 is adapted to be accommodated in the sump in a position to be in the path of rising water so that, in the event that water rises beyond a predetermined level, the float 15 will rock counterclockwise from the position shown in FIG. 1 and rotate the operator 14 to move the actuating valve from its closed to its open position. The significance of this construction will be explained shortly.

The control housing 4 comprises a tubular body 16 having an inlet 17, a relatively high volume water outlet 18, and an annular partition 19 separating the inlet from the outlet. The partition has a circular opening 20 therein and the opening is encircled by a seat 21.

Figure 2:
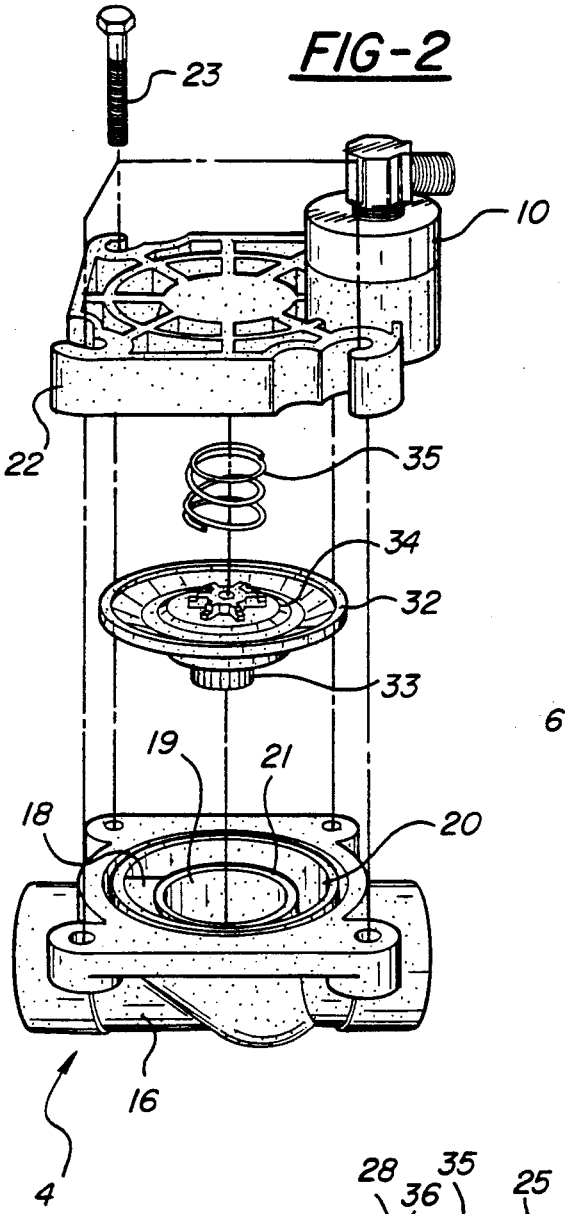
FIG. 2 is an exploded, isometric view of the control apparatus.
Figure 3:
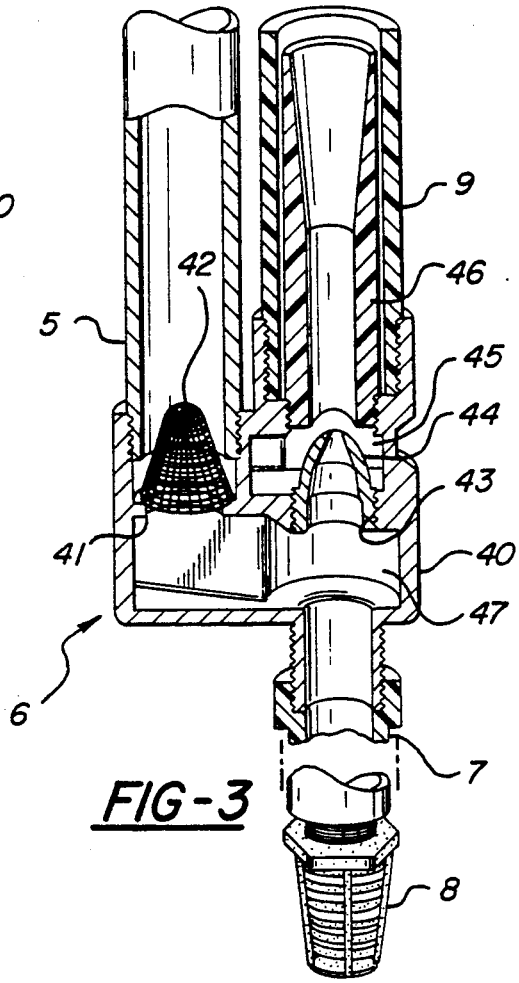
FIG. 3 is a fragmentary, isometric view of the suction generating apparatus.
Figure 4:
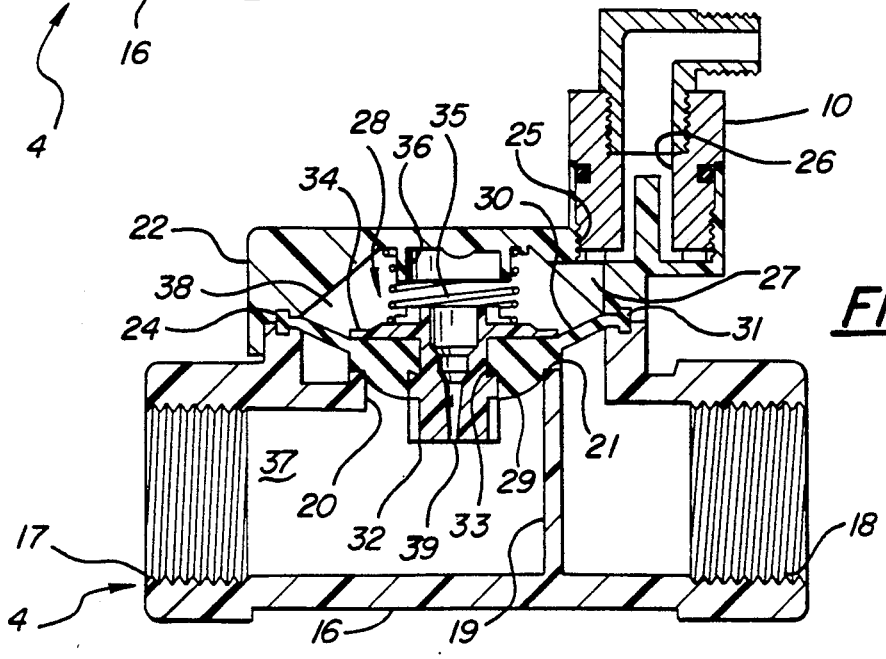
FIG. 4 is an enlarged sectional view through the control housing.

The control housing 4 also includes a cap 22 which overlies the body 16 and is removably secured thereto by a plurality of bolts 23, one of which is shown in FIG. 2. The confronting ends of the body 16 and the cap 22 are recessed to form an annular groove 24. At one end of the cap 22 is an opening 25 in which the fitting 10 is accommodated. The fitting 10 has an internal passage 26 which communicates at one end with the bleed line 11 and at its opposite end with a port 27 formed in the cap 22.

A closure 28 normally seals the opening 20 and comprises a flexible diaphragm 29 having a web 30 spanning the groove 24 and having a peripheral enlargement 31 accommodated in such groove. At the center of the diaphragm is a plug 32 which extends through and seals an opening 33 in the diaphragm. The plug has a flange 34 which seats on the diaphragm. The diaphragm normally is maintained by a spring 35 in a position in which it closes the opening 20. One end of the spring seats on the flange 34 and the opposite end encircles a guide 36 and bears against the cap 22. The force of the spring 35 is such as to maintain the closure 28 in sealing relation with the opening 20 when pressure on opposite sides of the diaphragm is substantially equal.

The closure diaphragm 29 forms two chambers in the central housing 4. One chamber, 37, communicates with the inlet 17 and the other chamber, 38, communicates with the fitting 10 via the port 27. The chamber 37 hereinafter will be referred to as the inlet or uniform pressure chamber and the chamber 38 will be referred to hereinafter as the outlet or variable pressure chamber.

The plug 32 forming part of the diaphragm 29 has a relatively low volume water passageway 39 therein which provides fluid communication between the inlet chamber 37 and the chamber 38. The passageway 39 is open continuously and is of such size as to enable water to flow from the inlet chamber 37 to the outlet chamber 38.

The suction generating apparatus 6 is conventional and comprises a housing 40 having an inlet 41 in communication with the line 5 via a strainer 42 and an outlet 43 in which is accommodated a nozzle 44 that extends into a low pressure chamber 45 and is in axially spaced alignment with an injector 46. The lower part of the housing 40 forms a chamber 47 which communicates with both of the lines 5 and 9 and also with the drain line 7. The chamber 47 also communicates with the low pressure chamber 45.

To condition the apparatus for use, the supply line 1 is coupled to a source of water under pressure, preferably the potable water system of the building in which the sump is located. The drain line 7 is located in the sump in a position in which it will be able to be immersed in water rising in the sump. The operating float 15 is positioned in the sump at such level as to rock counterclockwise from the position shown in FIG. 1 in response to a rise to a predetermined level of water in the sump.

Normally, i.e., when the sump pump is inactive, the valve operated by the float 15 is closed, thereby sealing the lower end of the bleed line 11 and enabling the bleed line and both of the chambers 37 and 38 in the control housing 4 to be filled completely with water. Due to the presence of the passageway 39 through the diaphragm closure 28, the pressure of water in both of the chambers 37 and 38 and in the bleed line 11 will be the same, thereby enabling the spring 35 to maintain the diaphragm in passage-sealing relation on the seat 21.

Should the water level in the sump rise sufficiently to cause the float 15 to be rocked counterclockwise, thereby opening the valve in the valve housing 12, water in the bleed line 11 may pass the valve into the drain line 7 and lower the pressure in the bleed line 11 and in the outlet chamber 38. Lowering of the pressure in the chamber 38 will result in an excess of pressure in the inlet chamber 37, due to the substantially uniform pressure of the potable water supply, thereby enabling the closure 28 to be lifted off the seat 21 and establish fluid flow through the housing 4 between the inlet 17 and the outlet 18. Water flowing through the housing 4 will pass into the outlet line 5, flow through the suction generating apparatus 6, and through the discharge line 9. As the water passes through the suction generating apparatus 6, a low pressure will be generated in the chamber 45 thereby enabling water from the sump to be entrained in the drain line 7 and delivered to the discharge pipe 9 for disposal.

Water flowing through the drain line 7 past the open end of the valve housing 12 will lower the pressure at such open end, thereby assisting in maintaining a pressure in the outlet chamber 38 lower than that in the inlet chamber 37. The lower pressure in the chamber 38 will ensure that the passage 20 remains open between the inlet 17 and the outlet 18.

When the water level in the sump recedes to a level lower than the predetermined level, the float 15 rocks and closes the actuating valve, thereby sealing the bleed line 11 and enabling water to fill the bleed line and the chamber 38 to reestablish equalization of pressure in the chambers 37 and 38, whereupon the closure 29 again will return to its closed position and discontinue the flow of water through the control housing 5.

The disclosed embodiment is representative of a presently preferred embodiment of the invention, but is intended to be illustrative rather than definitive thereof. The invention is defined in the claims.

We claim:

1. A sump pump construction comprising a fluid inlet line for connection to a source of fluid under pressure; a fluid drain line for positioning in a sump in which liquid may collect and in communication with said inlet line; a fluid discharge line in communication with said drain line; a fluid outlet line in communication with said inlet line, said drain line, and said discharge line; suction generating means in communication with said inlet line, said drain line, and said discharge line for producing a negative pressure in said drain line in response to flow of fluid from said inlet line through said outlet line, thereby enabling liquid in said sump to be entrained in said drain line and said fluid discharge line; control means interposed between and in communication with said inlet line and said outlet line; a bleed line external of said control means and in communication with said control means and said drain line upstream of the communication of said drain line and said suction generating means; actuating valve means in said bleed line downstream of said control means and being movable between first and second positions in which fluid is selectively unable and able to flow from said control means through said bleed line; and operating means coupled to said valve means and responsive to a rise in level of liquid in said sump to move said valve means from said first position to said second position, said control means comprising a housing having a partition through which a passage extends for establishing fluid flow through said housing from said inlet line to said outlet line, a closure movable between first and second positions in which said closure respectively closes and opens said passage, said closure dividing said housing into an inlet chamber and an outlet chamber, and means yieldably biasing said closure to said first position, said closure having a passageway therethrough for admitting fluid from said inlet chamber to said outlet chamber when said valve means is in said first position and said closure is in said first position, thereby enabling pressures in each of said chambers to equalize and said biasing means to maintain said closure in said first position.

2. The construction according to claim 1 wherein said valve means is rotary and said operating means is operable to effect rotation of said valve means in opposite directions in response to a rise or fall in the level of liquid in said sump.

3. The construction according to claim 1 wherein said closure comprises a flexible diaphragm.

4. The construction according to claim 3 wherein said diaphragm includes a plug through which said passageway extends.

5. In a water powered sump pump having an inlet line connectable to a source of water under pressure, a relatively high volume outlet line in communication with said inlet line for receiving water therefrom, a drain line locatable in a sump in which water may collect and in communication with said outlet line, suction generating means responsive to the flow of water through said inlet line and said outlet line to create a low pressure sufficient to entrain in said drain line water from said sump, and control means for selectively enabling and disabling the flow of water from said source through said inlet line and said outlet line, the improvement wherein said control means comprises a housing having a first chamber in communication with said inlet line; an outlet in communication with said outlet line; a passage connecting said inlet chamber and said outlet; a closure movable from a first position in which said passage is closed to a second position in which said passage is open; means yieldably biasing said closure to said first position; a variable pressure second chamber in said housing; a relatively low volume water passageway between said chambers; a bleed line in communication at one end with said second chamber and at its other end with said drain line for enabling the discharge of water from said second chamber to said sump; actuating valve means external of said second chamber for selectively opening and closing said bleed line; and operating means coupled to said valve means and responsive to the rise of water in said sump to open said valve means and enable water to flow out of said second chamber to said sump via said bleed line, thereby reducing pressure in said second chamber and enabling the pressure of water in said first chamber to move said closure from said first position to said second position whereby water may flow from said source through said inlet line, said housing, and said outlet line.

6. The construction according to claim 5 wherein said bleed line communicates with said drain line upstream of said suction generating means.

7. The construction according to claim 5 wherein said valve means is rotary and said operating means is operable to effect rotation of said valve means.

8. The construction according to claim 5 wherein said housing has a partition therein, said passage being in said partition.

9. The construction according to claim 5 wherein said closure comprises a flexible diaphragm.

10. The construction according to claim 9 wherein said diaphragm includes a plug through which said passageway extends.

* * * * *